United States Patent [19]

Iwata

[11] Patent Number: 4,944,369

[45] Date of Patent: Jul. 31, 1990

[54] SAFETY DEVICE FOR ELEVATOR

[75] Inventor: Shigemi Iwata, Inazawa, Japan

[73] Assignee: Mitsubishi Denki Kabushiki Kaisha, Japan

[21] Appl. No.: 218,884

[22] Filed: Jul. 14, 1988

[30] Foreign Application Priority Data

Jul. 17, 1987 [JP] Japan ..... 62-178292

[51] Int. Cl.[5] ..... B66B 5/02

[52] U.S. Cl. ..... 187/105; 361/76

[58] Field of Search ..... 187/105; 361/76, 85

[56] References Cited

U.S. PATENT DOCUMENTS

| | | | |
|---|---|---|---|
| 3,961,688 | 6/1976 | Maynard | 187/105 |
| 3,999,087 | 12/1976 | Compton | 361/76 X |
| 4,021,703 | 5/1977 | Gary et al. | 361/76 X |
| 4,155,427 | 5/1979 | Caputo et al. | 187/105 X |
| 4,751,653 | 6/1988 | Junk et al. | 361/76 X |

OTHER PUBLICATIONS

"Motor Technique in Field" issued by Ohn Co. by Akisuke Noguchi (Apr. 25, 1976) pp. 122–125. (partial translation).

*Primary Examiner*—Philip H. Leung
*Assistant Examiner*—W. E. Duncanson, Jr.
*Attorney, Agent, or Firm*—Leydig, Voit & Mayer

[57] ABSTRACT

A safety device for an elevator which has a converter for converting a 3-phase A.C. power source into a D.C. power source, a control circuit for the elevator employing as a power source the D.C. power source outputted from the converter, a level converter for converting the voltage of the D.C. power source outputted from the converter into a logic level, and defective phase detecting means for detecting the defective phase of the 3-phase A.C. power source by dividing the output signal of the level converter in a time division manner.

9 Claims, 7 Drawing Sheets

FIG. 3
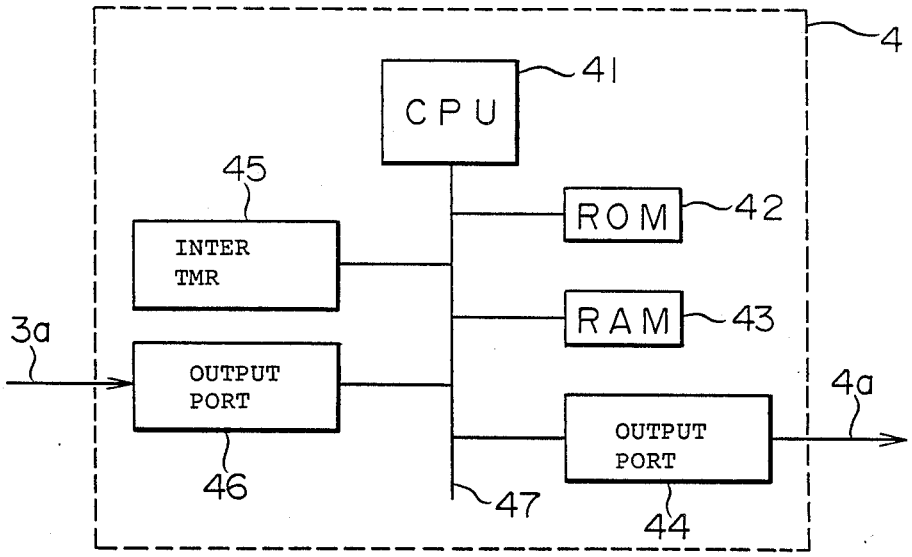
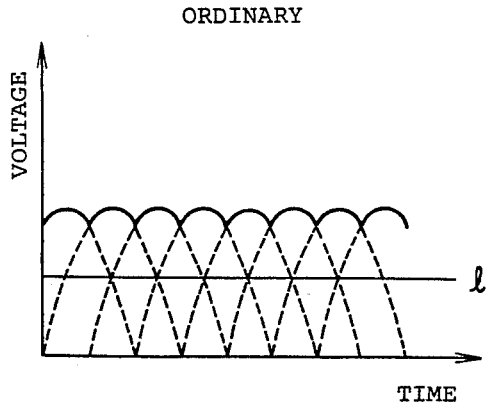
FIG.4a
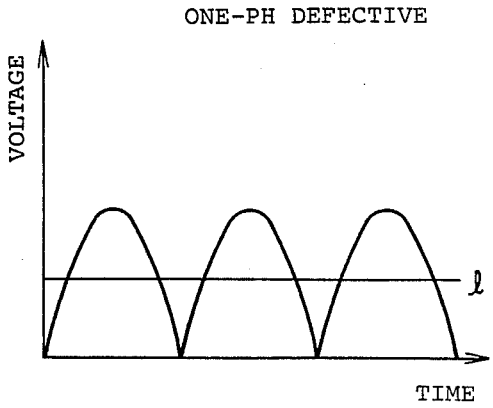
FIG.4b

SAFETY DEVICE FOR ELEVATOR

BACKGROUND OF THE INVENTION

The present invention relates to a safety device for an elevator and, more particularly, to a safety device having inexpensive defective phase detecting means which can be applied to a control device using a microcomputer.

A control circuit for controlling the service supervision of an elevator ordinarily converts 3-phase A.C. power sources into a D.C. power source and uses the D.C. power source as a power supply. This is because the circuit employing the D.C. power source can easily constitute a sequence circuit by relays having highly reliable contacts by using as mechanical contacts necessary for an elevator, for example governor contacts and door contacts.

A power source for driving an A.C. motor for driving an elevator cage or a cage door employs 3-phase A.C. power sources.

If a 3-phase A.C. power source in a building develops a defective phase, the A.C. motors for driving the cage and the door become impossible to rotate forward or to reversely rotate, and an extremely dangerous state thus occurs. If the 3-phase A.C. power sources in a building develops a defective phase, it becomes impossible for the control circuit to function normally. Accordingly, if the 3-phase A.C. power source in the building develops a defective phase, in the prior-art elevator system, a safety device for abruptly stopping the elevator cage to secure the safety of passengers in the cage is employed.

FIG. 11 is a circuit diagram showing a prior-art safety device of an elevator. Reference numeral 1 denotes 3-phase A.C. power sources in a building, and numeral 2 denotes a converter for full-wave rectifying the 3-phase outputs of the 3-phase A.C. power sources 1 by using diodes. Numeral 5 denotes a defective phase detecting relay connected to the output terminals of the 3-phase A.C. power sources 1, numeral 6 denotes a safety relay of an elevator which outputs an abrupt stop command to an elevator cage and which is connected through a make contact $G_1$ of a mechanical governor (not shown) and a make contact $P_1$ of the defective phase detecting relay 5 between the output terminals of the converter 2. Numeral 7 denotes an up contactor which outputs an up command to a cage driving motor (not shown), and which is connected through a make contact $UA_1$ of an upward command relay (not shown) and a make contact $A_1$ of the safety relay 6 between the output terminals of the converter 2. Numeral 8 denotes a down contactor which outputs a down command to the cage driving motor and which is connected through a make contact $DA_1$ of a downward command relay (not shown), and the make contact $A_1$ of the safety relay 6 between the output terminals of the converter 2.

In the safety device for the elevator constructed as described above, when the output of the 3-phase A.C. power source 1 is normal, the defective phase detecting relay 5 is energized, and its contact $P_1$ is accordingly closed. When the contact $P_1$ is closed, a current flows in a circuit of the positive (+) terminal of the power source, the make contact $P_1$ of the detective phase detecting relay 5, the make contact $G_1$ of the mechanical governor, the safety relay 6 and the negative (−) terminal of the power source. Thus, the safety relay 6 is energized. When the safety relay 6 is energized, its contact $A_1$ is closed. Therefore, the circuit of the positive terminal of the power source, the contact $UA_1$, the up contactor 7 and the negative terminal of the power source is formed to energize the up contactor 7.

Here, if any one phase of the 3-phase A.C. power source becomes defective for any reason during the upward operation of the elevator cage, the defective phase detecting relay 5 is deenergized, and its contact $P_1$ is opened. When the safety relay 6 is deenergized, its contact $A_1$ is opened to deenergize the up contactor 7. Thus, since the power supply to the cage driving motor is interrupted, the upward operation of the cage is abruptly stopped. This similarly operates the cage even during the downward operation of the cage.

The above-mentioned defective phase detector is stipulated by the law to be installed as a safety device by the ANSI, CODE in the U.S.A. and by the CEN, CODE in Europe.

Since the prior-art safety device for the elevator is constructed as described above, an exclusive unit, such as the defective phase detecting relay must be employed. Thus, the elevator system becomes expensive. Further, in a controller for an elevator by a microcomputer, in order to load the output signal of a unit by the contact configuration of the defective phase detecting relay, it has such a drawback that an interface must be employed.

SUMMARY OF THE INVENTION

The present invention has been made to eliminate the above-described drawbacks and has for its object to provide a safety device for an elevator having inexpensive defective phase detecting means which can be applied to a controller for an elevator by using a microcomputer.

The safety device for an elevator according to the present invention detects a defective phase by using a level converter for level-converting the voltage of a D.C. power source obtained by rectifying a 3-phase A.C. power source and a time division process for dividing a logic signal of the output of the level converter in a time division manner.

Since the safety device for an elevator according to the present invention detects the defective phase by level-converting the voltage of the D.C. power source obtained by rectifying the 3-phase A.C. power source and dividing the converted voltage in a time division manner, a voltage signal can be easily used together with a signal of other safety contacts in the elevator.

BRIEF DESCRIPTION OF THE DRAWINGS

FIG. 3 is a circuit diagram of defective phase detecting means 4 shown in FIG. 1;

FIG. 4 are views for explaining the principle of the operation of the safety device for the elevator according to the present invention, wherein FIG. 4(*a*) is a waveform diagram of a D.C. voltage supplied through the converter 2 in FIG. 1 when the 3-phase A.C. power source is normal, and FIG. 4(*b*) is a waveform diagram of the D.C. voltage when one of 3-phase A.C. power sources is defective.

In the drawings, the same symbols indicate identical or corresponding portions.

DESCRIPTION OF THE PREFERRED EMBODIMENTS

Figure 1:
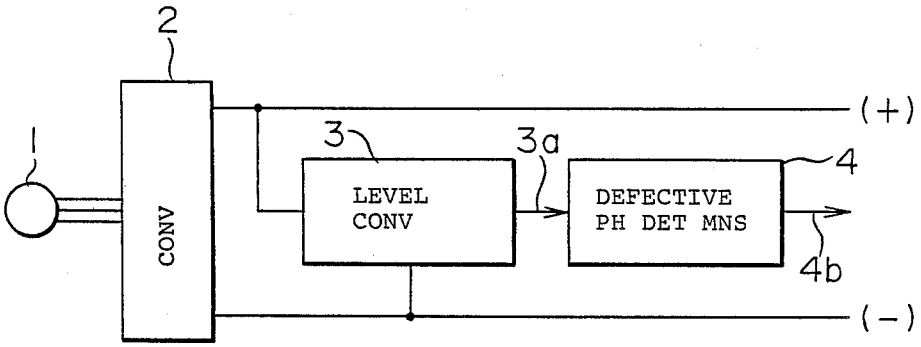
FIG. 1 is a view showing the entire construction of a safety device for an elevator according to an embodiment of the present invention.

Embodiments of the present invention will be described with reference to the accompanying drawings. In FIG. 1, reference numeral 1 denotes a 3-phase A.C. power source in a building, and numeral 2 denotes a converter for full-wave rectifying the 3-phase outputs of the 3-phase A.C. power source 1 by using diodes. Numeral 3 denotes a level converter for converting the output of the converter 2 into, for example, 5 V adapted for the input of a microcomputer as a voltage logic level, and numeral 4 denotes defective phase detecting means for detecting a defective phase by dividing the output signal of the level converter 3 in a time division manner (e.g., by a process of a microcomputer).

Figure 2:
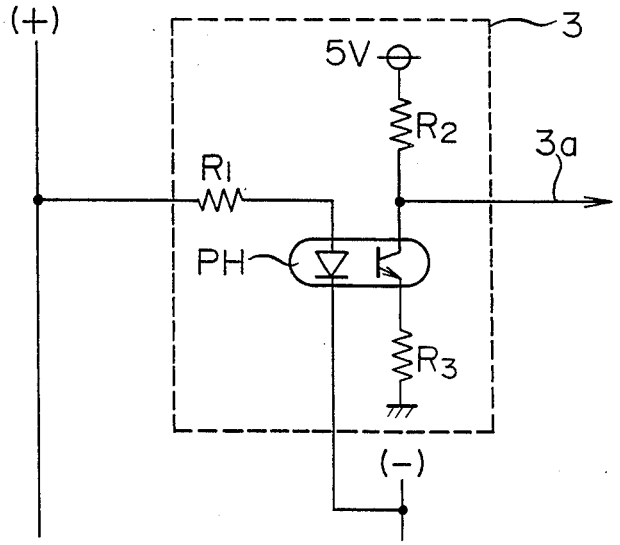
FIG. 2 is a circuit diagram of a level converter 3 shown in FIG. 1.

FIG. 2 is a detailed circuit diagram of the level converter 3 shown in FIG. 1. In FIG. 2, symbols $R_1$ to $R_3$ denote resistors, symbol PH denotes a photocoupler, and symbol 3*a* denotes an output signal.

FIG. 3 is a detailed circuit diagram of the defective phase detecting means 4 shown in FIG. 1. In FIG. 3, numeral 41 denotes a central processing unit (hereinafter referred to as "a CPU"), numeral 42 denotes a read-only memory (hereinafter referred to as "ROM"), numeral 43 denotes random access memory (hereinafter referred to as "RAM"), numeral 44 denotes an output port, numeral 45 denotes an interrupt timer, numeral 46 denotes an input port, and numeral 47 denotes a bus, and the units are connected through the bus 47 to each other.

Here, the D.C. power source of the control circuit supplied from the converter 2 is converted by the level converter 3 into a logic level, and the conversion output signal 3*a* is inputted through the input port 46 to the CPU 41. The CPU 41 executes the calculation by multiple periods, for example, at every 1.25 msec. in a short period and at every 50 msec. in a long period. When model 8085A (of Intel Co.) is used, for example, as the CPU 41, model 8155 (of INTEL Co.) can be employed as the interrupt timer 45. In this case, an interrupt control signal of a program at every 1.25 msec or 50 msec. can be used. The determination of whether the A-C power source is defective or not is executed by the above-described microcomputer system.

FIG. 4 is a view for explaining the principle of the operation of the safety device for the elevator according to the present invention. When the 3-phase A.C. power source is normal, the waveform of the D.C. voltage supplied through the converter 2 shown in FIG. 1 is as shown in FIG. 4(*a*). On the other hand, the D.C. voltage waveform of the converter 2 when one of the 3-phase A.C. power sources becomes defective is as shown in FIG. 4(*b*). Accordingly, with the level l in FIGS. 4(*a*) ,and 4(*b*) as a reference, it is determined to be "1" when the level is higher than the reference l, and "0" when it is lower than the reference. Accordingly, the "0" case occurs only when a defective phase exists. Therefore, whether or not the 3-phase A.C. power source 1 is defective can be determined in response to the level of the output signal of the level converter 2, i.e., "1" or "0". For example, since the 3-phase A.C. ordinarily has 50 or 60 Hz, the output signal 3*a* of the level converter 3 is read at every 1 to 3 msec., and the A-C power source is determined to be defective if the state "0" exists and to be normal if the state "1" continues to exist.

Referring to FIGS. 6 to 10, the operation of the embodiment in FIGS. 1 to 3 will be described in more detail.

Figure 5:
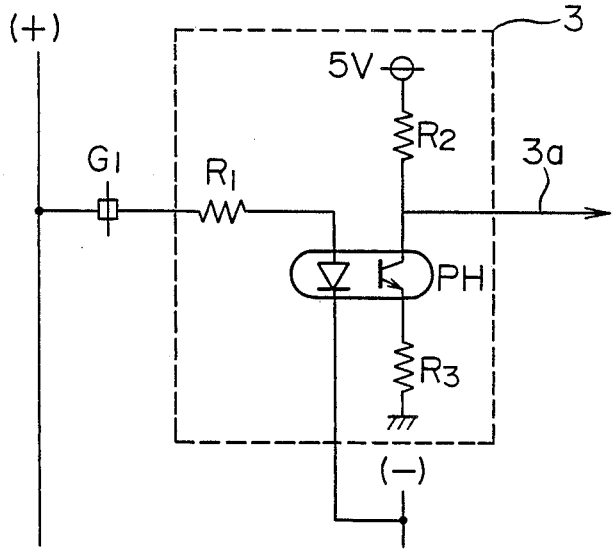
FIG. 5 is a circuit showing a converter for converting a signal supplied through a governor contact into a logic level signal.

FIG. 5 shows a circuit for converting the signal supplied through the governor contact $G_1$ into a logic level signal, corresponding to the circuit shown in FIG. 2. The different points between both are such that the circuit in FIG. 2 directly inputs the D.C. signal, while FIG. 5 inputs the D.C. signal through the governor contact operated when the elevator cage runs at a dangerous speed over the rated speed.

Figure 6:
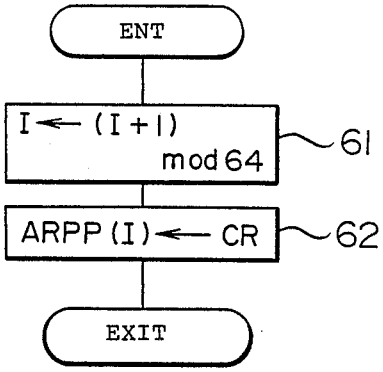
FIG. 6 is a flow chart showing part of the operation of the defective phase detecting means 4.

FIG. 6 is a flow chart showing part of the operation of the defective phase detecting means 4 to be executed at every 1.25 msec of the short calculating period stored in the ROM 42 shown in FIG. 2. The variable I in this case is a pointer, and the output signal 3*a* of the level converter 3 shown in FIG. 5 is stored as a CR signal in the program in an array variable ARPP (I). At step 61, 1 is added to the pointer I. However, since the array variable ARPP(·) obtains areas for only 64, it calculates the residue as mod 65. Then, the ON/OFF state of the governor contact $G_1$ shown in FIG. 5 is inputted as "1"/"0" of the logic level to the CR to be stored in the array variable ARPP(·).

Figure 7:
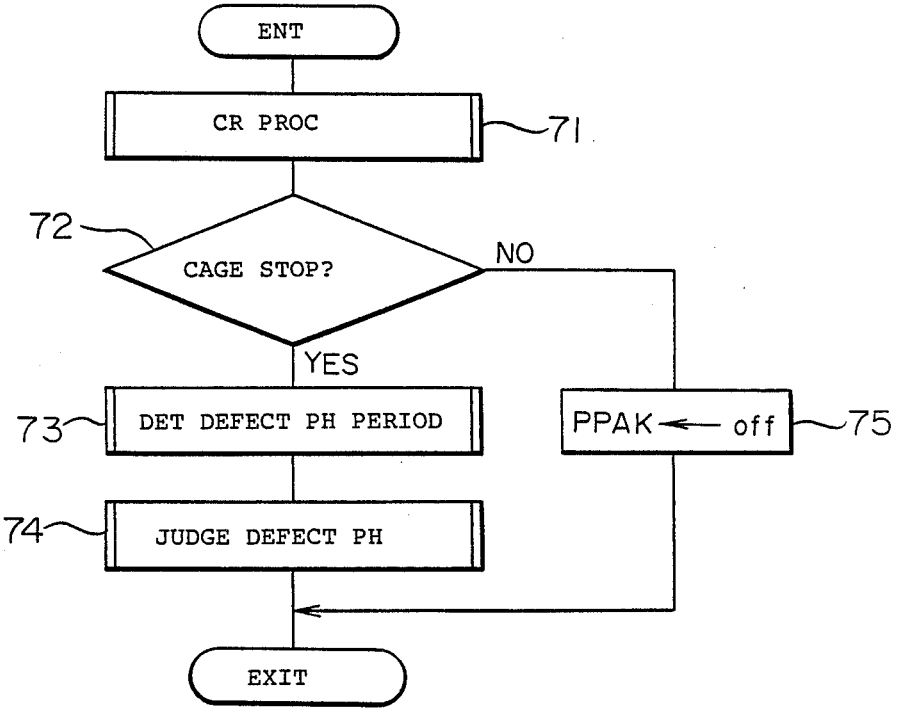
FIG. 7 is a flow chart showing part of the operation of the detective phase detecting means 4 similarly to FIG. 6.

FIG. 7 is a flow chart showing part of the operation of the defective phase detecting means 4 to be executed at every 50 msec. of the long calculating period stored in the ROM 42 shown in FIG. 2. Then, the state of the governor contact is determined according to the ARPP(·) stored in the process shown in FIG. 6 in step 71. Then, whether the cage is stopping or not is determined in step 72. If it is stopping, the control is shifted to step 73, while if it is running, the control is shifted to step 75. If the D.C. power source is converted to the single phase full-wave power according to the ARPP(·) stored in the process shown in FIG. 6, in step 73, its period is detected. Whether the 3-phase A.C. power source is defective or not is determined in response to the result of step 73, in step 74. A defective phase flag PPAK is set OFF in step 75.

In the foregoing description, ON/OFF state of the governor contact is determined as shown in step 71 and whether or not the 3-phase A.C. power source is defective is determined in steps 73 and 74. This is because the operation of the governor due to the excessive speed of the cage and the defective phase of the power source are desired to be distinguished in the supervision sequence of the elevator. The outputs of the abrupt stop commands of the elevator cage in both of these malfunctions are the same, and the abrupt stop command is outputted by the microcomputer system shown in FIG.

3. In order to detect the defective phase of the 3-phase A.C. power sources, if the determined level l shown in FIG. 4(*b*) is not set to a certain higher degree than a predetermined level, the output signal 3*a* of the level converter 3 shown in FIG. 2 does not positively become "1" or "0". In other words, if the determined level l is low, the output signal 3*a* becomes "1" at almost all times, so that the state "0" cannot be detected at 1.25 msec. of the short period of the microcomputer system. If the determined level l is high, the above-described inconvenience is eliminated, but if the signal of the governor contact $G_1$ is considered, the probability that an erroneous operation due to noise occurs, i.e., it is judged as OFF at a moment it becomes high. Thus, it is preferable to clearly distinguish the step 71 from the steps 73 and 74. The reason why the period of the processes in steps 73 and 74 is limited to the periods during which the cage is stopped is because, if the processes occur during the running mode of the cage, power source distortion (notch) due to a thyristor control is generated in the 3-phase A.C. power source when the cage driving motor is controlled by the power converter, such as a thyristor. In order that the defective phase detecting means may not erroneously operate due to the power source distortion, it is preferable to limit the determination of the defective phase only the periods during which the cage is stopped.

The microcomputer as the defective phase detecting means can also operate the controls of the hall calls, elevation, stopping and the torque control function of the cage driving motor.

Figure 8:
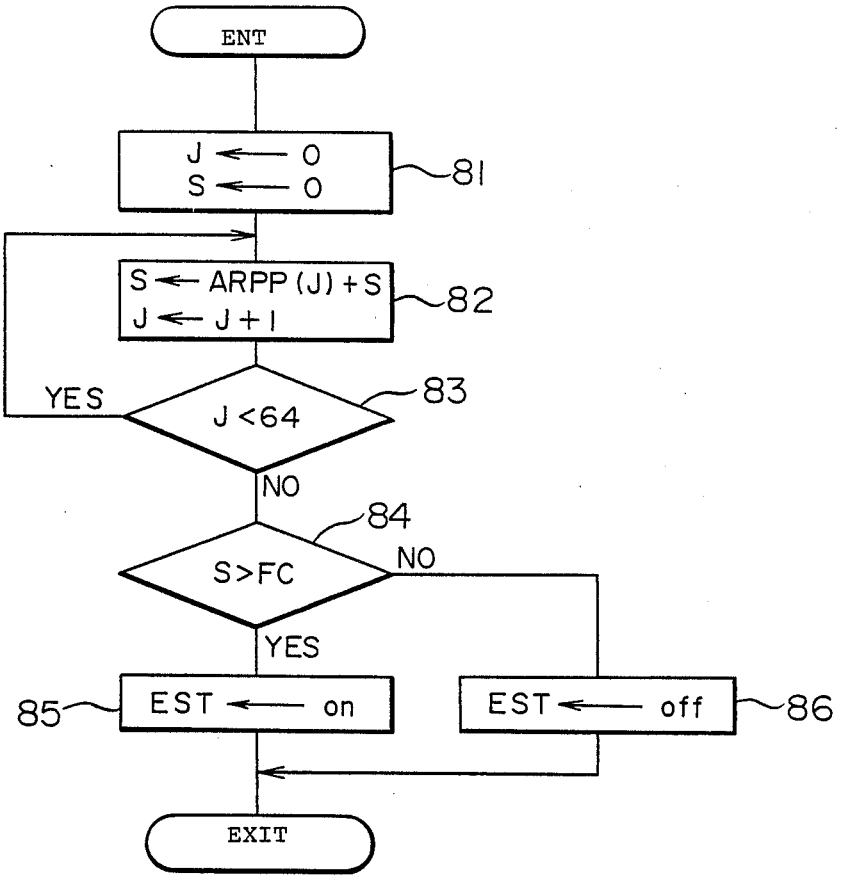
FIG. 8 is a flow chart showing the detail of CR process in step 71 of FIG. 7.

FIG. 8 is a flow chart showing the detail of the CR process shown in step 71 in FIG. 7. Since 64 "1" or "0" are stored in the array variable ARPP(·), when the sum of the total is calculated, compared with the set value (FC is selected to approx. 8), the abrupt stop command EST is set to OFF if it is larger than the set value, and it is set to ON if it is smaller than the set value. In step 81, a pointer J is set to "0", and the sum S is set to "0". Then, in step 82, $$S \leftarrow ARPP(J)+S$$

$$J \leftarrow J+1$$

are executed. In step 83, the process is shifted to step 82 if the J is less than 64, and it is shifted to step 84 if J is more than 64. In step 84, the process is shifted to step 85 if the sum is larger than the predetermined set value FC, and it is shifted to step 86 if the sum is less than the predetermined set value FC. In step 85, the abrupt stop command EST is set to ON. In step 86, the abrupt stop command EST is set to OFF.

Figure 9:
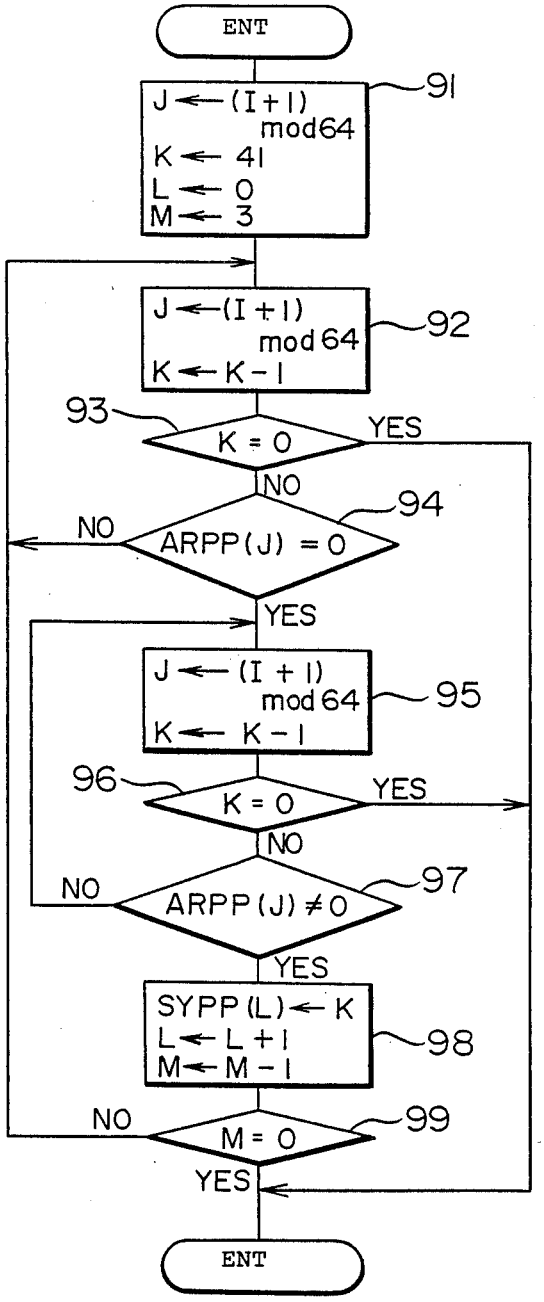
FIG. 9 is a flow chart showing the detail of defective phase perior detection in step 73 of FIG. 7.

FIG. 9 is a detailed flow chart of the detective phase detecting period shown in step 73 of FIG. 7. Symbol J denotes a pointer, symbol K denotes the value of 0 to 41 of 41 of 64 of the array variables ARPP(·), symbol M denotes the number (3) of the defective phase period array SYPP(·), and symbol L denotes a pointer of the defective phase period array SYPP(·). In step 91, various variables are initialized. Then, in steps 92, 93 and 94, the process for searching one which initially becomes "0" of the array variable ARPP(·) is executed. In steps 95, 96 and 97, the process for searching one which then becomes "1" of the array variables ARPP(·) is executed. In step 98, the variable K when the ARPP(·)="1" in step 97 is stored in the defective phase period array SYPP(·). In step 99, the ones to be stored in the defective phase period arrays SYPP(·) are set to 3 at the maximum. Finally, the time when the array variable ARPP(·) is raised from "0" to "1" is written in the SYPP(0), SYPP(1), SYPP(2).

Figure 10:
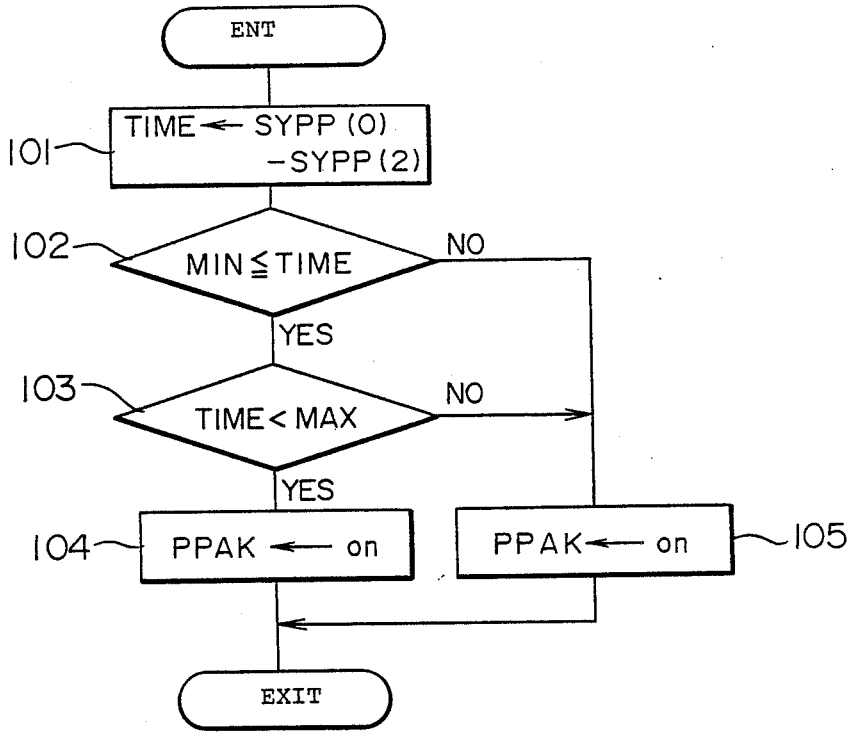
FIG. 10 is a flow chart showing the detail of the defective phase decision in step 74 of FIG. 7.
Figure 11:
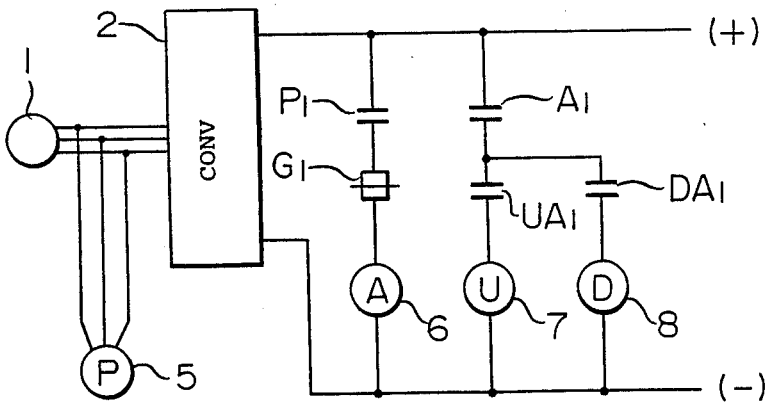
FIG. 11 PRIOR ART
FIG. 11 is a view of the entire construction of the prior-art safety device for an elevator.

FIG. 10 is a flow chart showing the detail of the defective phase judgement shown as step 74 in FIG. 7. In step 101, SYPP(0) −SYPP(2) is written in TIME. In other words, the three points that are raised from "0" to "1" are collected on the array variables ARPP(·), and the time difference is stored in the TIME. In steps 102 and 103, if the TIME falls between MIN and MAX, the process is shifted to step 104, while if the TIME is not disposed between the MIN and the MAX, the process is shifted to step 105.

Here, the MIN and the MAX are preset values, and may be, for example, selected to approx. 10 and 27. In other words, $10\times1.25=12.5$ msec. and $27\times1.25=33.3$ msec.

In case of the defective phase in 50 Hz, it can be judged to be defective at the time of 20 msec., and in case of the defective phase in 60 Hz, it can be judged to be defective at the time of 16.7 msec. Accordingly, in order to commonly judge for both 50/60 Hz, it may be set as described above. As the erroneous operation remedy, it can more reliably detect whether it falls within the minimum or maximum. Then, in step 104, a defective phase flag PPAK is set to ON, and in step 105, a defective phase flag PPAK is set to OFF.

As described above, if the defective phase flag PPAK is ON, an abrupt stop command is outputted to the elevator. Since the microcomputer system in FIG. 3 controls as other functions, such as the cage service supervision, it can be easily performed. The abrupt stop command is outputted directly as the signal 4*a* through the output port 44 in FIG. 3.

According to the present invention as described above, the defective phase of the 3-phase A.C. power sources is determined by sampling the voltage signal at the D.C. power source side and it is determined during the time division process in the elevator control circuit in which the 3-phase A.C. power sources are full-wave rectified as a D.C. power source. Therefore, the voltage signal can be used also as the signal of the safety contact in other elevators, and can be easily applied to the elevator controller using the microcomputer system to obtain an inexpensive system.

What is claimed is:

1. A safety device for an elevator comprising:

a converter which converts a 3-phase A.C. power supply into a D.C. power supply having a voltage waveform which remains substantially at peak value and above a reference value for all single phase periods of the power supply voltage and, when one or more phases of the power supply voltage are defective, drops to a low voltage below the reference value during any defective single phase periods, a control circuit for the elevator employing as a power supply the D.C. power supply outputted from said converter, a level converter which converts the voltage waveform of said D.C. power supply outputted from said converter into a logic level signal with a different logic level for, respectively, peak value periods representing an uninterrupted power supply and low voltage periods representing one or more defective phases, and defective phase detecting means for detecting a defective phase of the 3-phase A.C. power supply by sampling the logic level signal of said level converter in a time division manner and determining a defective phase in response to the level of the logic level signal.

2. A safety device for an elevator according to claim 1, wherein said defective phase detecting means comprises a microcomputer for controlling the service supervision of an elevator.

3. A safety device for an elevator according to claim 2, wherein said defective phase detecting means comprises a micro computer and the logic level signal converted by said level converter is supplied as an input to the microcomputer which is operated under program control to sample the logic level signal and determine a defective phase in response to the level of the signal.

4. A safety device for an elevator according to claim 3, wherein said level converter has a photocoupler included in a circuit which provides the logic level signal with a different logic level for peak value periods or low value periods of the voltage wave form of the D.C. power supply.

5. A safety device for an elevator according to claim 2, wherein said microcomputer controls the service supervision of the elevator.

6. A safety device for an elevator accorrding to claim 5, wherein said microcomputer controls the process for calling, the run and stop of a cage and the torque of a cage driving motor.

7. A safety device for an elevator according to claim 2 wherein said microcomputer operates under a program wherein the logic level signal is sampled only when all elevator cages are stopped and which permits defective phase detection for both 50Hz and 60Hz power supply.

8. A safety device for an elevator according to claim 1, wherein said level converter is supplied a signal representing the voltage waveform of said D.C. power supply through a contact of a mechanical governor.

9. A safety device for an elevator according to claim 8, wherein said defective phase detecting means judges the defective phase only during a cage stopping period.

* * * * *